US007446747B2

(12) United States Patent
Youngblood et al.

(10) Patent No.: US 7,446,747 B2
(45) Date of Patent: Nov. 4, 2008

(54) MULTIPLE CHANNEL PROGRAMMABLE GAMMA CORRECTION VOLTAGE GENERATOR

(75) Inventors: Douglas L. Youngblood, Palm Bay, FL (US); Steven R. Smith, Melbourne, FL (US)

(73) Assignee: Intersil Americas Inc., Milpitas, CA (US)

( * ) Notice: Subject to any disclaimer, the term of this patent is extended or adjusted under 35 U.S.C. 154(b) by 743 days.

(21) Appl. No.: 10/766,197

(22) Filed: Jan. 28, 2004

(65) Prior Publication Data

US 2005/0057482 A1 Mar. 17, 2005

Related U.S. Application Data

(60) Provisional application No. 60/502,366, filed on Sep. 12, 2003.

(51) Int. Cl.
*G09G 3/36* (2006.01)

(52) U.S. Cl. ..... 345/100; 345/99; 348/674

(58) Field of Classification Search ..... 345/87–103, 345/204–205, 690, 211; 348/284, 294, 377, 348/388.1, 674; 341/154; 315/366; 250/208.1; 347/226

See application file for complete search history.

(56) References Cited

U.S. PATENT DOCUMENTS

| | | | | |
|---|---|---|---|---|
| 6,157,335 | A * | 12/2000 | Suzuki et al. | 341/154 |
| 6,359,389 | B1 * | 3/2002 | Medina et al. | 315/169.1 |
| 6,424,281 | B1 * | 7/2002 | Liaw et al. | 341/144 |
| 6,476,591 | B2 * | 11/2002 | Yamaguchi et al. | 323/369 |
| 6,577,285 | B1 | 6/2003 | Motonakano et al. | |
| 7,023,458 | B2 * | 4/2006 | Kudo et al. | 345/690 |
| 2002/0101416 | A1 * | 8/2002 | Woo et al. | 345/212 |
| 2002/0109655 | A1 * | 8/2002 | Yer et al. | 345/87 |
| 2002/0126112 | A1 * | 9/2002 | Kato | 345/204 |
| 2002/0158862 | A1 * | 10/2002 | Chen et al. | 345/211 |
| 2002/0186231 | A1 | 12/2002 | Kudo et al. | |
| 2003/0048248 | A1 * | 3/2003 | Fukumoto et al. | 345/89 |
| 2003/0122757 | A1 * | 7/2003 | Bu | 345/87 |
| 2003/0132906 | A1 * | 7/2003 | Tanaka et al. | 345/89 |
| 2003/0142084 | A1 * | 7/2003 | Chang et al. | 345/204 |
| 2004/0233182 | A1 * | 11/2004 | Chuang et al. | 345/204 |

OTHER PUBLICATIONS

Codonics Gamma Correction, Technical Brief, Copyrighted 1995, 1998 U.S.A.

PCT Notification of Transmittal of the International Search Report or the Declaration, dated May 3, 2005, 3 pages.

* cited by examiner

*Primary Examiner*—Abbas I Abdulselam
(74) *Attorney, Agent, or Firm*—Gary R Stanford

(57) ABSTRACT

A multiple channel programmable gamma correction voltage generator including a resistor ladder, buffers, select logic, and a programmable non-volatile memory device. The memory provides select values indicative of one or more stored gamma correction values. The resistor ladder includes adjustable tap resistors distributed along the resistor ladder. The adjustable tap resistors provide multiple tap voltages distributed according to the gamma correction value. The buffers receive the tap voltages and provide gamma correction voltages. The select logic selects tap points of the adjustable tap resistors to select the tap voltages based on the select values stored in the memory. Additional resistors and switch logic may be included to enable re-positioning of the adjustable tap resistor within the resistor ladder. Latches and address control may be provided on the memory to enable programming and selection of multiple gamma correction values.

21 Claims, 6 Drawing Sheets

MULTIPLE CHANNEL PROGRAMMABLE GAMMA CORRECTION VOLTAGE GENERATOR

CROSS-REFERENCE TO RELATED APPLICATIONS

This application claims the benefit of U.S. Provisional Application No. 60/502,366 filed on Sep. 12, 2003, which is herein incorporated by reference for all intents and purposes.

BACKGROUND OF THE INVENTION

1. Field of the Invention

The present invention relates to gamma correction for imaging devices, and more particularly to a multiple channel programmable gamma correction generator for imaging devices, such as display panels including LCD TFTs and the like.

2. Description of the Related Art

Imaging devices, including printers or display devices such as CRTs and LCD panels and the like, typically do not respond to input voltage in a linear manner. The luminance or brightness produced by a display device, for example, is not directly proportional to the input signal level, resulting in an overly dark or overly bright image and a nonlinear gray scale. In addition, LCD panels tend to have problems with motion causing the moving display to smear and the dynamic range or contrast ratio to become compressed, further obscuring (e.g., darkening) the image. The nonlinear response of such imaging devices is referred to as "gamma" and is represented as a gamma factor, number or value. If gamma is not compensated, the original image is not accurately reproduced.

Gamma compensation is achieved by applying a gamma correction response that is the inverse of the imaging device response so that the overall system response approaches a more linear transfer function. Manufacturers of imaging products, such as LCD TFT display panels or the like, often incorporate gamma correction to ensure that the original image is reproduced properly. Conventional solutions, however, are typically incorporated on a part-by-part basis, such that the gamma solution integrated into one product line or model is not applicable to another. Programmable gamma devices are known, but are usually implemented for a specific model, or otherwise are implemented using costly discrete devices and/or power-hungry amplifiers.

SUMMARY OF THE INVENTION

A multiple channel programmable gamma correction voltage generator according to an embodiment of the present invention includes a reference voltage applied across a resistor ladder, M buffers, select logic, and a programmable non-volatile memory device, where M is a positive integer. The memory device provides M select values indicative of a stored gamma correction value. The resistor ladder includes M adjustable tap resistors distributed along the resistor ladder. Each adjustable tap resistor provides a corresponding one of M tap voltages distributed according to the gamma correction value. Each buffer has an input receiving a corresponding tap voltage and an output providing a corresponding one of M gamma correction voltages. The select logic selects a tap point of each adjustable tap resistor to select the tap voltages based on the select values stored in the memory.

In one embodiment, each adjustable tap resistor includes P resistors coupled in series forming P-1 intermediate junctions and P-1 switches, where P is also positive integer. Each switch has a first terminal coupled to a corresponding intermediate junction and a second terminal coupled to a common tap node. Each adjustable tap resistor includes a common tap node providing a corresponding one of the M tap voltages. In one embodiment of this configuration, the select logic includes decoder logic which closes one of the P-1 switches of each adjustable tap resistor to select each of the M tap voltages based on M select values from the memory device. The decoder logic may include M decoders, each receiving a corresponding select value and selecting a corresponding switch of a corresponding adjustable tap resistor.

The resistor ladder may include M+1 first resistors evenly distributed along the resistor ladder forming M intermediate locations. In one configuration, each adjustable tap resistor is coupled between a respective pair of the first resistors at a corresponding one of the M intermediate locations. In an alternative embodiment, the first resistors are further subdivided into multiple resistors and the select logic includes switch logic that selectively positions the adjustable tap resistors among the multiple resistors. In particular, at least M of the first resistors each include Q second resistors and the switch logic includes Q switch sets. The Q second resistors are coupled in series forming Q-1 intermediate locations and an end location. Each switch set is coupled between a respective pair of the second resistors at a corresponding one of the Q intermediate locations or the end location. Each switch set is operative, when selected, to decouple the Q second resistors at a corresponding intermediate location or the end location and to insert a corresponding adjustable tap resistor at the decoupled location. In this configuration, the adjustable tap resistors may further be subdivided into resistors and the select logic into switches. In one case, the memory asserts first signals to select from among the switch sets of each first resistor for gross adjustment and asserts second signals to select from among the switches of each adjustable tap resistor for fine adjustment. In another case, the select logic includes decoder logic which provides a set of M gross adjustment values and a set of M fine adjustment values to select each of the M tap voltages based on a corresponding M select value.

The multiple channel programmable gamma correction voltage generator may further include a set of latches with an external load coupled to the memory device and providing the select values to the select logic. In this configuration, the memory device stores one or more sets of select values, each corresponding to a different gamma correction value. The memory device includes an address control input for selecting from among the sets of select values and loading the latches accordingly.

The resistor ladder may be incorporated into a single integrated circuit (IC) to improve drift over time and temperature. For display configurations, the visual characteristics of a display panel are improved along with the quality of the image. The buffers, select logic and memory device may all be incorporated into the IC to reduce component count and board area.

An IC according to an embodiment of the present invention includes a resistor ladder coupled to a reference voltage, adjustable tap resistors, a programmable non-volatile memory, select logic and buffers. The adjustable tap resistors are distributed along the resistor ladder and provide selectable tap voltages. The memory stores at least one digital gamma value. The select logic selects each of the selectable tap voltages according to a digital gamma value. The buffers have inputs receiving selected tap voltages and outputs providing gamma correction voltages.

An imaging system according to an embodiment of the present invention includes an imaging device having a gamma factor, a driver circuit and a programmable gamma correction voltage generator. The driver circuit provides a set of DC reference voltages to the imaging device based on a set of gamma corrected bias voltages. The programmable gamma correction voltage generator provides the set of gamma corrected bias voltages configured to compensate for the gamma factor. The programmable gamma correction voltage generator may be implemented according to any of the embodiments previously described. The programmable gamma correction voltage generator may be implemented using discrete devices or incorporated on an IC. Separate control logic may be included and coupled to the memory via address control, where the control logic enables selection from among multiple digital gamma values stored in the memory.

BRIEF DESCRIPTION OF THE DRAWING(S)

The benefits, features, and advantages of the present invention will become better understood with regard to the following description and accompanying drawings in which.

Figure 1:
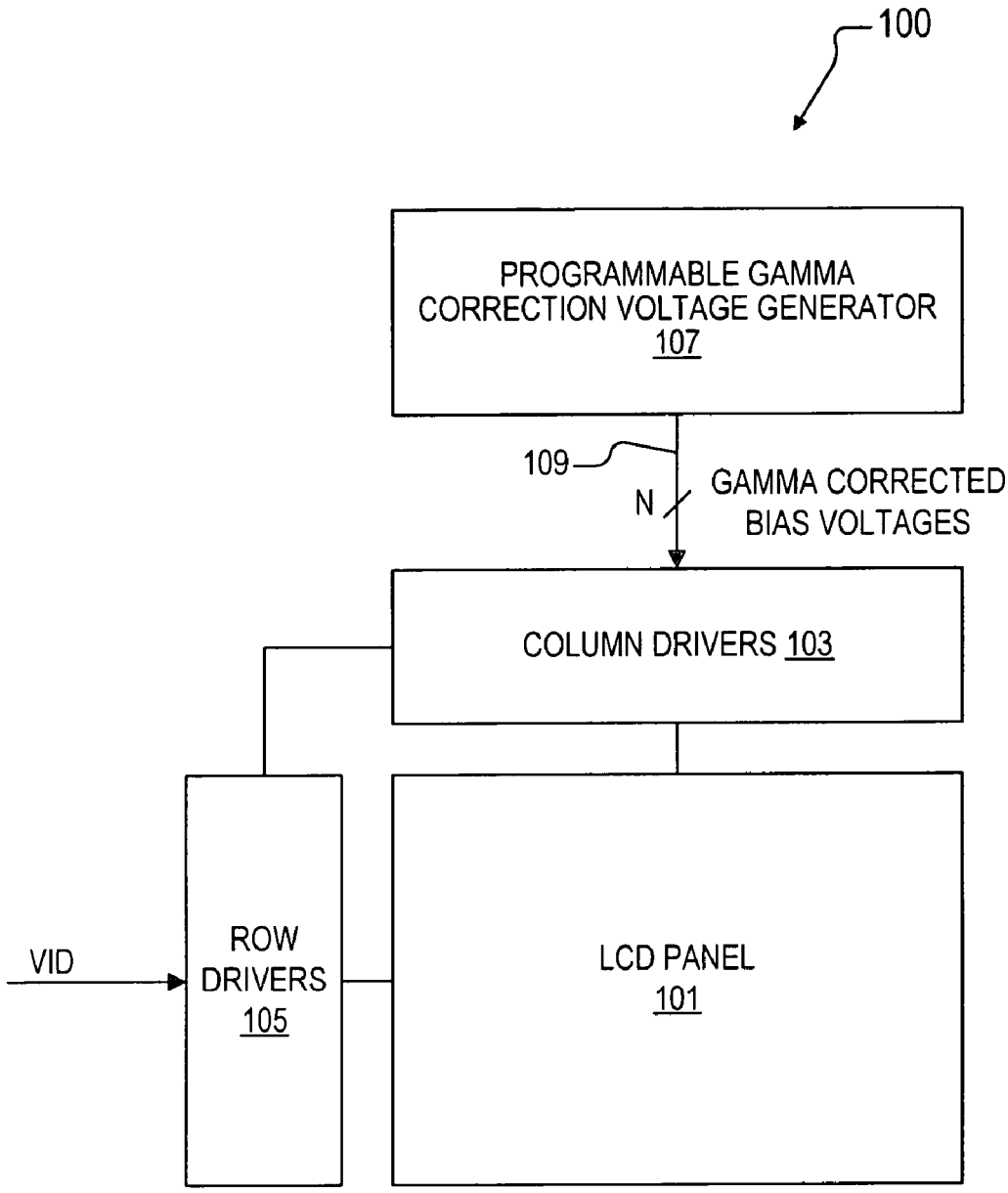
FIG. 1 is a simplified block diagram of a display system including a programmable gamma correction voltage generator implemented according to an embodiment of the present invention.
Figure 3:
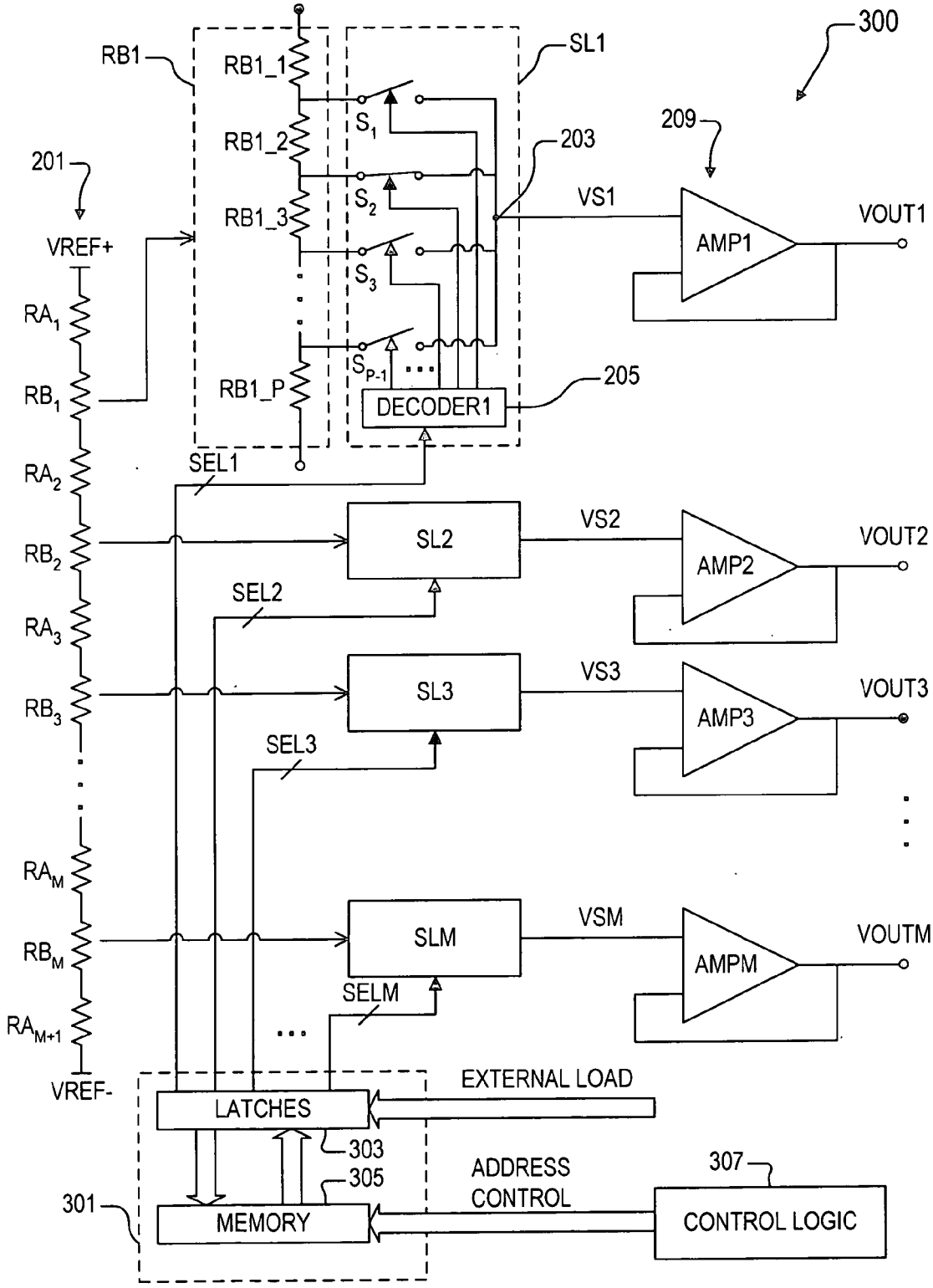
FIG. 3 is a more detailed schematic diagram of a multiple channel programmable gamma correction, voltage generator with dynamic gamma correction implemented according to another exemplary embodiment of the present invention, which also may be used as the programmable gamma correction voltage generator of FIG. 1.
Figure 4:
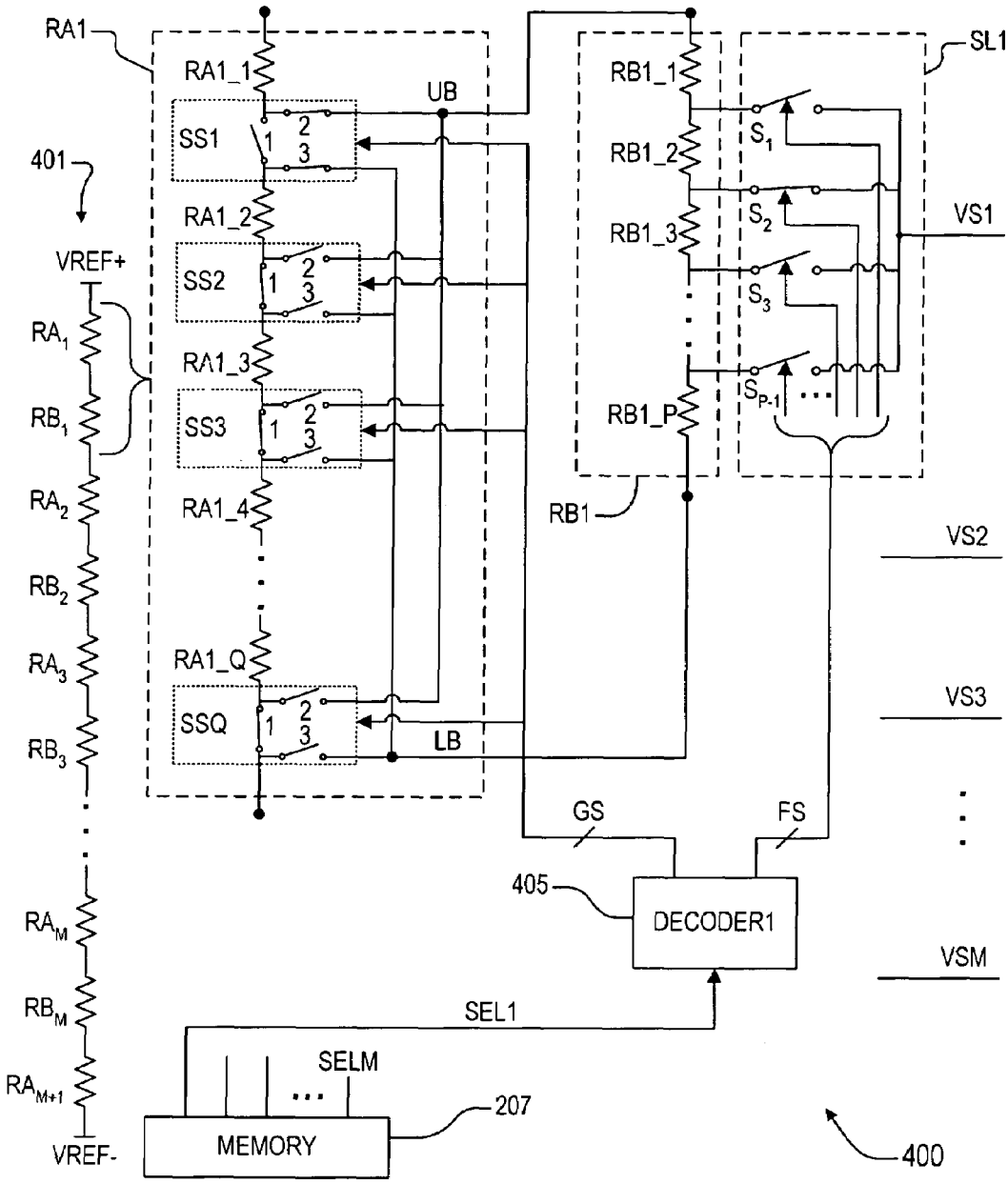
FIG. 4 is a more detailed schematic diagram of a multiple channel programmable gamma correction voltage generator with gross and fine adjustment implemented according to another exemplary embodiment of the present invention, which also may be used as the programmable gamma correction voltage generator of FIG. 1.
Figure 5:
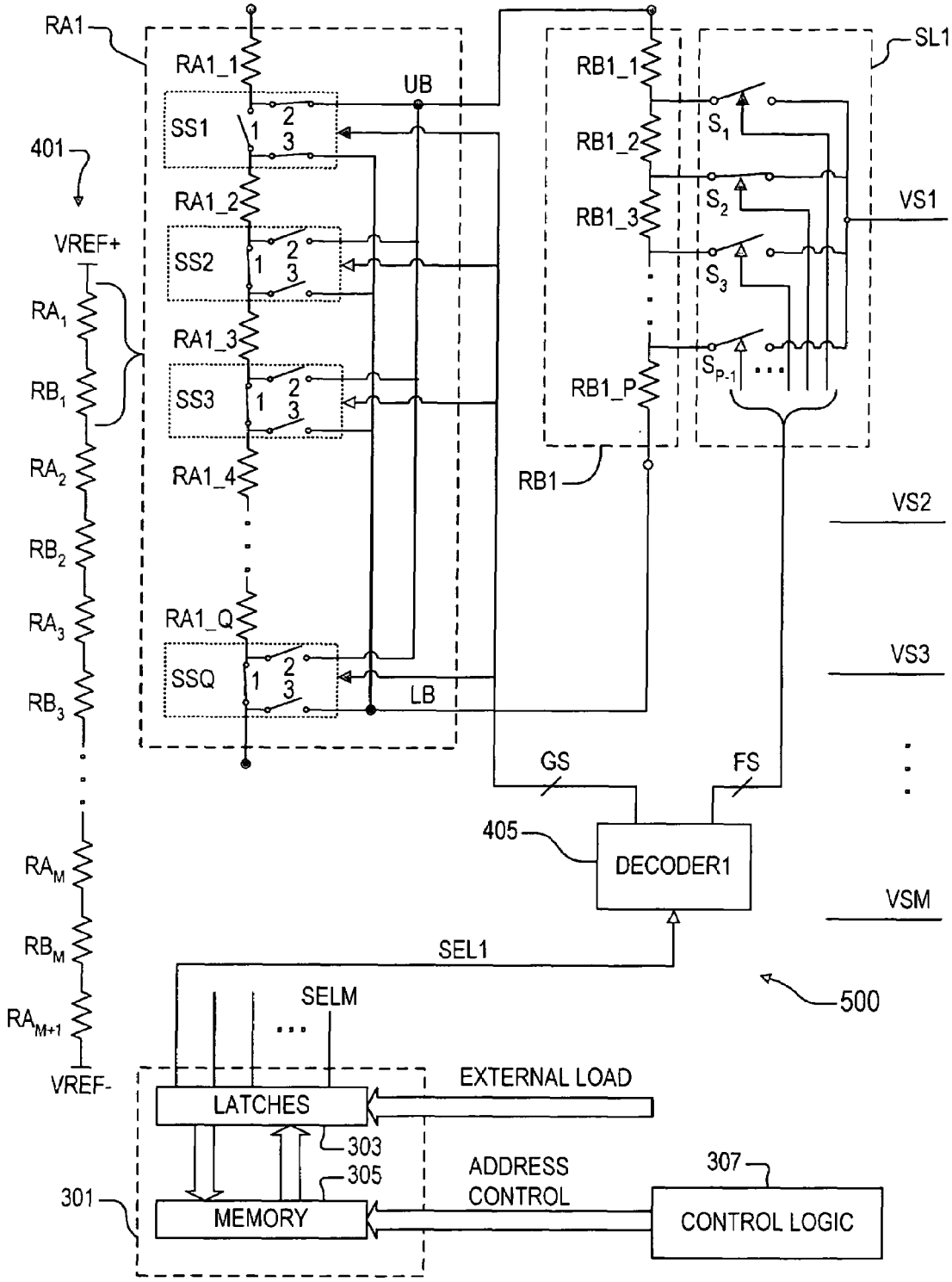
Figure 6:
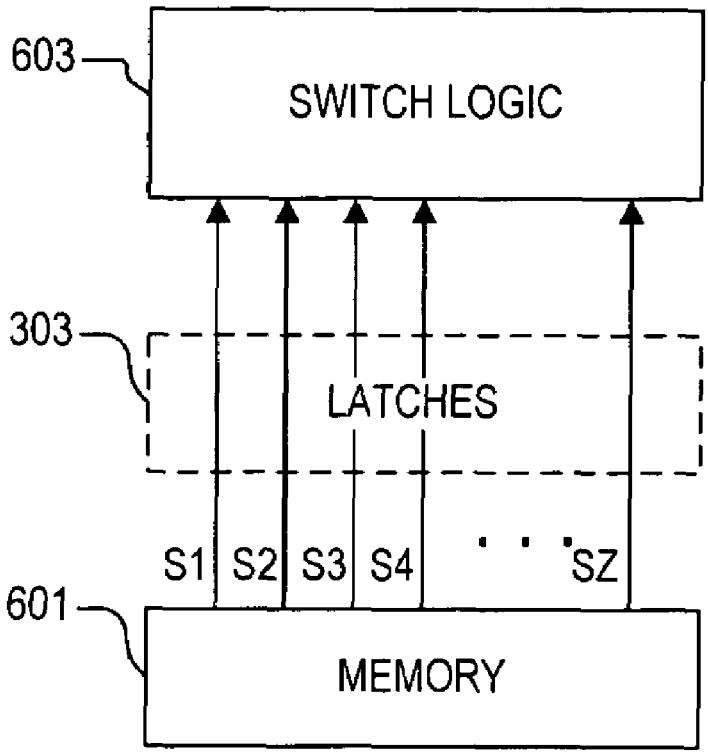

FIG. 5 is a more detailed schematic diagram of a multiple channel programmable gamma correction voltage generator with dynamic gamma correction and with gross and fine adjustment implemented according to another exemplary embodiment of the present invention, which also may be used as the programmable gamma correction voltage generator of FIG. 1; and FIG. 6 is a simplified block diagram illustrating alternative embodiments of a portion of the generators of FIGS. 2-5 in which the decoder logic is eliminated and in which the non-volatile memory directly controls the switches and switch sets to select the tap voltages.

DETAILED DESCRIPTION

The following description is presented to enable one of ordinary skill in the art to make and use the present invention as provided within the context of a particular application and its requirements. Various modifications to the preferred embodiment will, however, be apparent to one skilled in the art, and the general principles defined herein may be applied to other embodiments. Therefore, the present invention is not intended to be limited to the particular embodiments shown and described herein, but is to be accorded the widest scope consistent with the principles and novel features herein disclosed.

FIG. 1 is a simplified block diagram of a display system 100 including a programmable gamma correction voltage generator 107 implemented according to an embodiment of the present invention. The display system 100 includes a liquid crystal display (LCD) panel 101, such as used for computer systems or the like, although other types of display and/or imaging technology is contemplated. For example, gamma correction according to the present invention may also be applied for cathode ray tubes (CRTs) or the like. Any type of LCD display technology is contemplated, including thin film transistor (TFT) LCD displays or the like. A programmable gamma correction voltage generator according to the present invention may also be applied to other imaging technologies in similar manner, such as printers and the like.

In the configuration shown, the LCD panel 101 includes an array of picture elements or "pixels" (not shown) arranged in rows and columns. In a typical configuration as shown, a set of column drivers 103 and row drivers 105 are coupled to the LCD panel 101 for controlling the illumination of each pixel according to image information provided by a video signal VID. The column drivers 103 provide a set of DC reference or bias voltages and the VID signal is received and converted by the row drivers 105 to enable conversion and display of the image information. The image information may include, for example, any selected one or combination of pictures, graphics, video, screenshots, etc. The programmable gamma correction voltage generator 107 provides a set of "N" bias voltages on a corresponding set of data signal lines 109 to the column drivers 103, where "N" is a positive integer (e.g., N=18). The column drivers 103 further interpolate, refine and distribute the bias voltages among the columns of pixels of the LCD panel 101.

As known to those skilled in the art, each pixel of the LCD panel 101 does not respond to the input signal (e.g., input voltage) in a linear manner. More particularly, the luminance or brightness produced is not directly proportional to the input signal level, resulting in an overly dark or overly bright image and a nonlinear gray scale. In addition, LCD panels tend to have problems with motion causing the moving display to smear and the dynamic range or contrast ratio to become compressed, further obscuring (e.g., darkening) the image. The nonlinear response of the LCD panel 101 is referred to as "gamma" and is represented as a gamma factor, number or value. If gamma is not compensated, the original images are not accurately reproduced. Assuming the VID signal is not gamma corrected, if the bias voltages asserted on signal lines 109 are linearly distributed, then the image reproduced on the LCD panel 101 will not accurately represent the image information incorporated in the VID signal.

The programmable gamma correction voltage generator 107 is programmed according to a gamma compensation curve that is generally the inverse of the gamma response of the LCD panel 101 so that the LCD panel 101 displays an accurate representation of the image information of the VID signal. A user, such as a manufacturer of the LCD panel 101, measures the gamma response of their particular display model and programs the voltage generator 107 accordingly with the appropriate gamma correction to compensate for the gamma response. Independent programmability of each channel voltage, such as using non-volatile memory or the like, to permanently store the gamma correction allows any specific circuit to be used for any manufacturer's gamma voltage function for any display model they produce. In an alternative embodiment, multiple gamma voltage settings are programmed and permanently stored in the memory and are called up in real time based on an address provided to control pins. In this dynamic configuration, a new set of connections can be loaded in between the completion of the display of one frame and the start of a new frame.

Figure 2:
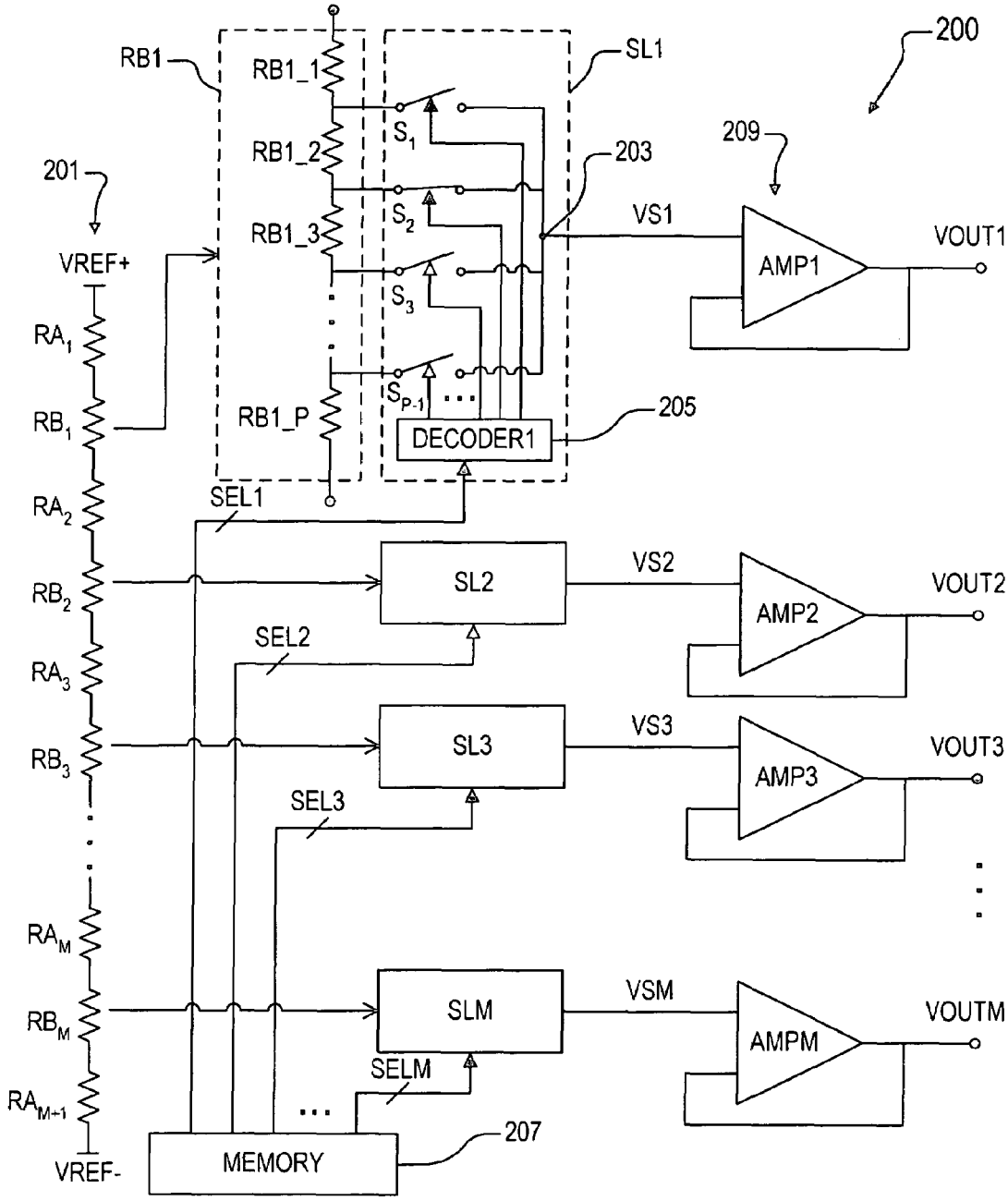
FIG. 2 is a more detailed schematic diagram of a multiple channel programmable gamma correction voltage generator implemented according to an exemplary embodiment of the present invention, which may be used as the programmable gamma correction voltage generator of FIG. 1.

FIG. 2 is a more detailed schematic diagram of a multiple channel programmable gamma correction voltage generator 200 implemented according to an exemplary embodiment of the present invention, which may be used as the programmable gamma correction voltage generator 107. A reference voltage (VREF+ to VREF−) is provided externally or generated internally and applied across a resistor ladder 201 including a string of 2M+1 series-connected resistors, where "M" is a positive integer. In one embodiment, M is equal to N. In another embodiment, M is related to N, such as a subset or the like (e.g., N includes the M tap voltages plus the reference voltages VREF+ and VREF− as selectable tap points). The resistors alternate between a first set of resistors $RA_X$ and a second set of resistors $RB_X$ up to a last resistor $RA_{M+1}$, where the subscript "X" is an index value that ranges from 1 to M. As shown, VREF+ is coupled to one end of a first resistor $RA_1$, having its other end coupled to one end of a second resistor $RB_1$, having its other end coupled to one end of a third resistor $RA_2$, and so on up to a resistor $RB_M$ with one end coupled to one end of the last resistor $RA_{M+1}$, having its other end coupled to VREF−.

In one embodiment, the resistors are co-located, such as incorporated on a common integrated circuit (IC) or chip or the like, so they match each other and track each other as temperature varies. Each resistor or resistor set may be implemented in any suitable manner known to those skilled in the art depending upon the particular implementation, such as using standard IC fabrication techniques or the like. In one embodiment, all of the components of the generator 107 are implemented on a single IC reducing component count and board area. Alternatively, the generator 107 is implemented with discrete components, including discrete resistors and amplifiers. The particular resistance values of the $RA_X$ resistors and $RB_X$ resistors are chosen based on the particular implementation. In one embodiment, the $RA_X$ resistors have substantially identical resistance values and the $RB_X$ resistors also have substantially identical resistance values. The ratio of the resistances of the $RA_X$ and $RB_X$ resistors is selected to achieve a desired range of gamma correction values. In the embodiments shown, the $RA_X$ resistors are evenly distributed along the resistance ladder. The $RB_X$ resistors may also be evenly distributed; in an alternative embodiment as further described below, however, the relative position of each of the $RB_X$ resistors relative to a corresponding one of the $RA_X$ resistors is adjustable to achieve a wider range of gamma correction values.

The $RB_x$ resistors of the resistor ladder 201 are adjustable to enable selection of intermediate tap points. In one embodiment, each $RB_x$ resistor is an adjustable tap resistor having an adjustable tap point to adjust the relative tap voltage. In the embodiments described herein, the adjustable taps (for either or both resistors $RB_x$ and $RA_x$) are implemented using multiple series-coupled resistors and switch logic to select discrete intermediate junctions. The adjustable tap resistors may alternatively be referred to as potentiometers, which have a constant total resistance and an adjustable intermediate tap point. For the resistor ladder 201, each of the $RB_x$ resistors is further sub-divided as illustrated by an exploded view of the first resistor $RB_1$. The resistor $RB_1$ is further sub-divided into a series-connected string of P resistors RB1_1, RB1_2, . . . , RB1_P, where "P" is another positive integer. The number P is arbitrary and is based on the level of tap point granularity desired for a given implementation. Although not shown, each of the remaining $RB_x$ resistors $RB_2$, $RB_3$, . . . , $RB_M$ are sub-divided in a similar manner. Select logic is coupled to the intermediate junctions of each $RB_x$ resistor, where the select logic selects one of the intermediate junctions as a tap point selected for a channel voltage to be provided on a corresponding one of the signal lines 109. As shown, select logic SL1 includes P-1 switches $S_1$, $S_2$, . . . , $S_{P-1}$, each coupled to a corresponding intermediate junction of the resistor string RB1_1 - RB1_P.

In the embodiment shown, the switches $S_1$-$S_{P-1}$, are each implemented as single-pole, single-throw (SPST) switches, each having one pole or terminal coupled to a corresponding intermediate junction of the resistors RB1_1-RB1_P, and another pole coupled together at a common tap node 203 providing a selected tap voltage VS1. A decoder 205, labeled DECODER1, selects one of the switches $S_1$-$S_{P-1}$, for selecting one of the intermediate junctions as the tap point based on a digital value SELL. Each select logic SL1-SLM includes similar decoder logic. Although the decoder logic is shown as distributed, it may be implemented in a centralized manner if desired. Each of the switches $S_1$-$S_{P-1}$ are normally open in which the decoder 205 selects and closes one switch at a time to ensure only one tap point. As shown, for example, all of the switches $S_1$-$S_{P-1}$ are open except for switch $S_2$, which is closed to select the intermediate junction between the resistors RB1_2 and RB1_3 as the tap point for providing the VS1 signal. Additional select logic SL2, SL3, . . . , SLM are configured in substantially identical manner and coupled to corresponding resistors $RB_2$, $RB_3$, . . . , $RB_M$, respectively, for providing corresponding selected tap voltage signals VS1, VS2, . . . , VSM, respectively.

A non-volatile memory 207 stores gamma correction values and provides digital select values SEL1, SEL2, SEL3, . . . , SELM to the select logic SL1, SL2, SL3, . . . , SLM, respectively. The digital select values SEL1-SELM are distribed according to a desired gamma correction value or digital gamma value or correction factor. In one embodiment, each select logic SLx includes a digital decoder which performs a byte to individual switch mapping, allowing a memory cell or counter of the memory 207 to address an individual switch within each sub-group of each $RB_X$ resistor.

The selected tap voltages VS1-VSM are each provided to an input of a corresponding one of a set of M buffer amplifiers 209, individually labeled as AMP1, AMP2, AMP3, . . . , AMPM, respectively, which output buffered versions of the selected tap voltages, shown as VOUT1, VOUT2, VOUT3, . . . , VOUTM, respectively. In one embodiment, each of the buffer amplifiers 209 is an operational amplifier configured as a voltage follower, having its non-inverting input receiving the corresponding VSx signal and its inverting input coupled to its output for developing the corresponding VOUTx signal.

In operation, when a switch of a resistor $RB_X$ is addressed by a corresponding decoder, such as the decoder 205, it is closed forming a connection between the resistor ladder 201 and the non-inverting input of a corresponding buffer amplifier 209. The result is a set of voltages VOUT1-VOUTM at the outputs of the buffer amplifiers 209, each being a resistor-divided voltage level of the reference voltage VREF+-VREF− defined at the selected tap point. For example, if the total tap point resistance of the resistors between a selected tap point TPNT within the resistor ladder 201 and the lower reference voltage VREF− is RTAP, and the total resistance of the resistor ladder 201 is RTOT, then the voltage VTAP at the selected tap point TPNT is VTAP=RTAP*(VREF+−VREF−)/RTOT, where an asterisk "*" denotes multiplication and a forward slash "/" denotes division. Note that regardless of the particular combination of selected tap points, the total resistance of the resistor ladder 201 remains constant. The tap points are selected to program the relative voltage levels of VOUT1-VOUTM to corresponding to a selected gamma correction curve.

A non-volatile memory cell or the like is connected to the driver memory cell or counter, allowing a setting to be stored permanently during the testing or calibration phase of operation of the LCD panel 101. In this way, the gamma correction settings for a particular LCD panel are always available without any action from outside sources. Since the settings can be changed at any time by reprogramming the memory 207, a single gamma correction circuit architecture can be used for all manufacturers and styles of display panels, such as flat panel displays, TFT LCD displays, etc.

FIG. 3 is a more detailed schematic diagram of a multiple channel programmable gamma correction voltage generator 300 implemented according to another exemplary embodiment of the present invention, which also may be used as the programmable gamma correction voltage generator 107. The generator 300 is similar in configuration and operation as the generator 200, in which similar components assume identical reference numbers. For the generator 300, the memory 207 is replaced with a memory control system 301, but otherwise the systems are similar in operation. The memory control system 301 includes a non-volatile memory 305, which asserts the select values SEL1-SELM via a set of latches 303. The memory 305 is similar to the memory 207, except that it is configured to store multiple sets of select values SEL1-SELM, each corresponding to one of multiple different gamma correction curves or values. In this case, an address control is provided to the memory 305 from control logic 307 and an external load is provided to the latches 303. The external load allows programming of one or more different gamma correction curves into the memory 305, where the latches 303 are also controlled to provide a selected set of select values SEL1-SELM from the memory 305.

At any time, the latches 303 are loaded with a selected set of select values SEL1-SELM that have been previously stored in the memory 305 by the control logic 307 to apply the desired gamma correction. The control logic 307 is configured and implemented in any desired fashion to achieve dynamic gamma correction. The control logic 307 may be provided on the same chip or IC as the remaining components of the generator 300. Alternatively, the control logic 301 is external and accesses the memory 305 via external address control pins and/or signals. In one embodiment, the control logic 307 is controlled via firmware, such as to enable gamma selection by the underlying display system 100. In another embodiment, the control logic 307 is controlled via software, such as automatically by a software application or manually by a user of an imaging software application or the like. In yet another embodiment, the control logic 307 is controlled by hardware, such as by another control chip (not shown) or even by a manual control input (not shown) (e.g., slide-switch or the like) externally and manually controllable by the user. In one example, a new set of connections to implement a different gamma correction is loaded between the completion of one display frame and the start of another display frame.

FIG. 4 is a more detailed schematic diagram of a multiple channel programmable gamma correction voltage generator 400 implemented according to another exemplary embodiment of the present invention, which also may be used as the programmable gamma correction voltage generator 107. The generator 400 is similar to the generator 200, in which similar components assume identical reference numbers. The memory 207 is included and provides the select values SEL1-SELM in a similar manner as previoulsy described, although the select values may be modified to incorporate gross and fine adjustment, as further described below. The resistors $RB_X$ are included and are each further sub-divided as previoulsy described into a series-connected string of P resistors RB1_1-RB1_P. The select logic blocks SL1-SLM are provided, each including P-1 switches $S_1$-$S_{P-1}$, coupled to the intermediate junctions of the resistors $RB_x$ _1-$RB_x$ _P of a corresponding one of the resistors $RB_X$ in a similar manner as previously described for selecting a tap point for selecting the tap voltages VS1-VSM. The buffer amplifiers 209 are also included (but not shown in FIG. 4) for converting the VS1-VSM signals to the output signals VOUT1-VOUTM. The decoder 205 is replaced with a decoder 405 that asserts a set of digital fine select signals FS for controlling the switches $S_1$-$S_{P-1}$ in substantially the same manner as previously described. The decoder 405 includes additional functionality and asserts another set of digital gross select signals GS, as further described below.

The generator 400 includes a resistor ladder 401, which is similar to the resistor ladder 201 previously described including a string of 2M series-connected resistors $RA_X$ and $RB_X$. In this case, however, the resistors $RA_X$ are each further sub-divided into a series-connected string of Q resistors, where "Q" is another positive integer. The number Q is arbitrary and is also based on the level of tap point granularity desired for a given implementation in a similar manner as the number P. Also, each resistor $RA_X$ includes intermediate switch sets that enable the corresponding $RB_X$ resistor to be inserted between any of the series-connected string of Q resistors of the resistor $RA_X$, as further described below. As shown, the resistor $RA_1$ is illustrated by an exploded view showing the resistor $RA_1$ sub-divided into a series-coupled string of resistors RA1_1, RA1_2, RA1_3, . . . , RA1_Q. A set of Q switch sets SS1-SSQ are provided, each coupled between a corresponding consecutive pair of the string of resistors RA1_1-RA1_Q of the resistor $RA_1$ and at an end location after the last resistor RA1_Q. In particular, a first switch set SS1 is coupled between resistors RA1_1 and RA1_2, a second switch set SS2 is coupled between resistors RA1_2 and RA1_3, a third switch set SS3 is coupled between resistors RA1_3 and RA1_4, and so on up to a last switch set SSQ coupled below the last resistor RA1_Q.

In the embodiment shown, each switch set SS1-SSQ includes three SPST switches numbered 1, 2 and 3, including a first switch 1 coupled between adjacent resistors of the series string of resistors RA1_1-RA1_Q, an upper switch 2 having one pole coupled to the upper pole of switch 1 and a lower switch 3 having one pole coupled to the lower pole of switch 1. For the resistor $RA_1$, the second poles of the upper switches 2 are coupled together at a node UB, which is coupled to the upper node of the resistor $RB_1$ (e.g., to the upper end of the resistor RB1_1). Also, the second poles of the lower switches 3 are coupled together at a node LB, which is coupled to the lower node of the resistor $RB_1$ (e.g., to the lower end of the resistor RB1_P). The first switch set SS1, for example, includes a first switch 1 having a first pole coupled to RA1_1 and to one pole of switch 2, and a second pole coupled to RA1_2 and to one pole of switch 3. The other pole of switch 2 is coupled to UB and the other pole of switch 3 is coupled to LB. Although not shown, each of the remaining $RA_x$ resistors $RA_2$, $RA_3$, . . . , $RA_M$ other than the last resistor $RA_{M+1}$ are sub-divided in a similar manner, and include the switch sets SS1-SSQ coupled to the resistors $RA_x$ _1-$RA_x$ _Q in a similar manner and to the corresponding resistors $RB_2$, $RB_3$, . . . , $RB_M$, respectively, in a similar manner.

For the resistor $RA_1$, the switch sets SS1-SSQ are each controlled by a corresponding one of the GS digital signals from the decoder 405. Each switch set operates in the same manner in which the second and third switches 2 and 3 assume the same state (open versus closed) as each other and opposite the state of the first switch 1. Thus, for each switch set, when the first switch 1 is open, the switches 2 and 3 are closed and when switch 1 is closed, the switches 2 and 3 are open. For each switch set SS1-SSQ, when unselected or in a "de-selected" state, the switch 1 is closed and the switches 2 and 3 are open. Only one switch set SS1-SSQ of each of the resistors $RA_1$-$RA_M$ is selected at a time, and when selected, the switch set switches to open switch 1 and to close switches 2 and 3. When a switch set is selected, it effectively inserts the corresponding resistor $RB_X$ at that location. As shown for the resistor $RA_1$, for example, the switch set SS1 is selected and the switch sets SS2-SSQ are de-selected, so that switch 1 of switch set SS1 is open while switches 2 and 3 are closed effectively inserting the resistor $RB_1$ between resistor RA1_1 and RA1_2. If the switch set SSQ were selected instead, then the resistor $RB_1$ is inserted below the resistor $RA_1$, similar to the configuration of the resistor ladder 201. In this manner, the resistor ladder 401 differs from the resistor ladder 201 in that the resistors $RA_1$-$RA_M$ are each subdivided to include intermediate switches, and in which each $RB_X$ resistor is selected to be inserted at any discrete location "within" or just below the corresponding $RA_X$ resistor.

Decode logic, such as the decoder 405, is provided for each pair of $RA_X$ and $RB_X$ resistors and each asserts a corresponding pair of GS and FS signals. Each GS set of signals provides a gross or rough adjustment value which positions the $RB_X$ resistor relative to its corresponding $RA_X$ resistor. Thus, the GS signals allows a resistor $RB_X$ to be moved from just below the corresponding $RA_X$ resistor to any intermediate location in between the series-coupled resistors forming that $RA_X$ resistor. Each FS set of signals provides a fine adjustment value that selects a tap point within the $RB_X$ resistor. In this manner, each SEL1-SELM signal is configured to select a tap point at any intermediate junction of the $RA_X$ resistors by inserting the corresponding $RB_X$ resistors at the selected intermediate junction, and then to select any intermediate junction of that $RB_X$ resistor to further fine tune the tap point voltage. The memory 207 asserts the SEL1-SELM signals in a similar manner, except that the SEL1-SELM signals include additional digital signals to facilitate gross and fine adjustment for selections of the tap point.

FIG. 5 is a more detailed schematic diagram of a multiple channel programmable gamma correction voltage generator 500 implemented according to another exemplary embodiment of the present invention, which also may be used as the programmable gamma correction voltage generator 107. The generator 500 is similar in configuration and operation as the generator 400, in which similar components assume identical reference numbers. For the generator 500, the memory 207 is replaced with a memory control system 301, but otherwise the systems are similar. The memory control system 301 is configured and operates in substantially identical manner as previously described with reference to FIG. 3. The address control is provided to the memory 305 from the control logic 307 (internal or external) and an external load is provided to the latches 303. The external load allows programming of one or more different gamma correction curves into the memory 305, where the latches 303 are controlled to provide a selected set of select values SEL1-SELM from the memory 305. Again, the control logic 307 is configured and implemented in any desired fashion to achieve dynamic gamma correction.

A multiple channel programmable gamma correction voltage generator according to an embodiment of the present invention generates a series of accurate voltages used for gamma correction for image devices, such as LCD TFT display panels, CRTs, printers, etc. The accuracy is achieved by using a resistor divider network whose tap point is switched through an array of switches that are controlled by a non-volatile memory bank or register. Buffer amplifiers are used to provide drive capability to each of the tap points. All of these components can be integrated into one integrated circuit (IC), reducing component count and board area. Alternatively, the multiple channel programmable gamma correction voltage generator may be implemented with discrete devices, such as discrete resistors and operational amplifiers (op-amps).

In one embodiment, the non-volatile memory is addressed through control inputs to load data from an addressed location into the switch array to open and close the appropriate switches, connecting each of the buffer amplifiers to the desired tap points in the resistor ladder. This part is considered "dynamic" as a new set of connections can be loaded in between the completion of the display of a display frame and the start of a new one.

Independent programmability of each channel voltage using non-volatile memory to permanently store the results allows any specific circuit to be used for any manufacturer's gamma voltage function for any display model they produce. The integration into a single integrated circuit improves the drift over time and temperature, improving the visual characteristics of the display panel and the quality of the image. Multiple gamma voltage settings can be stored in non-volatile memory to be called up in real time, dependent only upon the address applied to the control pins.

FIG. 6 is a simplified block diagram illustrating alternative embodiments of a portion of the generators 200-500 in which the decoder logic (e.g., the decoders 205 or 405) is eliminated and in which the non-volatile memory directly controls the switches and switch sets (if applicable) to select the tap voltages. The decode logic is used to reduce the size of the non-volatile memory. In particular, the memories 207, 305 store encoded digital values SEL1-SELM, each used to control multiple switches or switch sets, where each digital value is expanded (or decoded) by the decoder logic to the individual switch control signals for controlling each of the switches and switch sets. Instead, as shown in FIG. 6, a non-volatile memory 601 replaces the memory 207 (for the generators 200, 400) or the memory 305 (for the generators 300, 500) and the decoders 205 or 405 are removed. The latches 303 are shown using dashed lines and used if the generators 300, 500 are implemented, but are otherwise not included. The switches $S_1$-$S_{P-1}$ of each resistor RBX and, if applicable, the switch sets SS1-SSQ of each applicable resistor RAX, are collectively represented as switch logic 603. The memory 601 asserts individual switch control signals S1-SZ to the switch logic 603, where "Z" is an integer representing the total number of switches or the total number of switches and switch sets of the switch logic 603 to be controlled. In this manner, instead of storing multiple digital values each controlling multiple switches, the memory 601 stores at least one bit for each switch or switch set. Although the size of the memory may be increased, the decoder logic is eliminated resulting in an implementation design trade-off.

Although the present invention has been described in considerable detail with reference to certain preferred versions thereof, other versions and variations are possible and contemplated. Those skilled in the art should appreciate that they can readily use the disclosed conception and specific embodiments as a basis for designing or modifying other structures for providing out the same purposes of the present invention without departing from the spirit and scope of the invention as defined by the appended claims.

The invention claimed is:

1. A multiple channel programmable gamma correction voltage generator, comprising:

a reference voltage applied across a resistor ladder;

said resistor ladder including M adjustable tap resistors distributed along said resistor ladder, each providing a corresponding one of M tap voltages distributed according to a gamma correction value, wherein M is a positive integer;

said resistor ladder comprising a plurality of first resistors coupled in series, each of said plurality of first resistors comprising a plurality of second resistors coupled in series forming a plurality of intermediate locations;

M buffers, each having an input receiving a corresponding one of said M tap voltages and an output providing a corresponding one of M gamma correction voltages;

select logic which inserts each of said M adjustable tap resistors into said resistor ladder into M of said plurality of first resistors by inserting a corresponding one of said M adjust adjustable tap resistors at a selected one of said plurality of intermediate locations of a corresponding one of said plurality of first resistors, and that selects a tap point of each of said M adjustable tap resistors to select each of said M tap voltages based on corresponding select values; and a programmable non-volatile memory device, coupled to said select logic, that provides said select values indicative of said gamma correction value.

2. The multiple channel programmable gamma correction voltage generator of claim 1, wherein:

each of said M adjustable tap resistors comprises P resistors coupled in series forming P-1 intermediate junctions, wherein P is a positive integer; and wherein said select logic comprises P-1 switches, each having a first terminal coupled to a corresponding one of said P-1 intermediate junctions and a second terminal coupled to a common tap node providing a corresponding one of said M tap voltages.

3. The multiple channel programmable gamma correction voltage generator of claim 2, wherein said select logic includes decoder logic which closes one of said P-1 switches of each of said M adjustable tap resistors to select each of said M tap voltages based on a corresponding one of M select values from said memory device.

4. The multiple channel programmable gamma correction voltage generator of claim 3, wherein said decoder logic comprises M decoders, each receiving a corresponding one of said M select values and selecting a corresponding one of said P-1 switches of a corresponding one of said M adjustable tap resistors.

5. The multiple channel programmable gamma correction voltage generator of claim 1, wherein:

said plurality of first resistors includes M+1 first resistors evenly distributed along said resistor ladder forming M intermediate locations;

wherein at least M of said first resistors each comprise Q second resistors coupled in series forming Q-1 intermediate locations and an end location, wherein Q is a positive integer;

wherein said select logic comprises Q switch sets, each coupled between a respective pair of said second resistors at a corresponding one of said Q intermediate locations and said end location; and wherein each of said switch sets is operative, when selected, to decouple said Q second resistors at a corresponding one of said Q-1 intermediate locations and said end location and to insert a corresponding one of said M adjustable tap resistors.

6. The multiple channel programmable gamma correction voltage generator of claim 5, further comprising:

each of said M adjustable tap resistors comprising P third resistors coupled in series forming P-1 intermediate junctions, wherein P is a positive integer; and said select logic comprising P-1 switches, each having a first terminal coupled to a corresponding one of said P-1 intermediate junctions and a second terminal coupled to a common tap node providing a corresponding one of said M tap voltages.

7. The multiple channel programmable gamma correction voltage generator of claim 6, wherein said memory device asserts first signals to select from among said switch sets of each said first resistor for gross adjustment and asserts second signals to select from among said switches of each of said M adjustable tap resistors for fine adjustment.

8. The multiple channel programmable gamma correction voltage generator of claim 6, wherein said select logic comprises decoder logic which provides a set of M gross adjustment values and provides a set of M fine adjustment values to select each of said M tap voltages based on a corresponding one of said M select values, wherein each said gross adjustment value selects a corresponding one of said switch sets, and wherein each fine adjustment value selects a corresponding one of said switches.

9. The multiple channel programmable gamma correction voltage generator of claim 1, further comprising a set of latches with an external load coupled to said memory device and providing said select values to said select logic.

10. The multiple channel programmable gamma correction voltage generator of claim 9, wherein said memory device stores a plurality of sets of select values, each corresponding to a different gamma correction value, and wherein said memory device includes an address control input for selecting from among said plurality of sets of select values and loading said set of latches.

11. The multiple channel programmable gamma correction voltage generator of claim 1, wherein said resistor ladder is incorporated into a single integrated circuit (IC).

12. The multiple channel programmable gamma correction voltage generator of claim 11, wherein said buffers, select logic and memory device are incorporated into said IC.

13. The multiple channel programmable gamma correction voltage generator of claim 1, wherein each of said M buffers comprises an operational amplifier configured as a voltage follower.

14. An integrated circuit (IC), comprising:

a resistor ladder coupled to a reference voltage;

a plurality of adjustable tap resistors distributed along said resistor ladder and providing a plurality of selectable tap voltages;

a plurality of first resistors distributed along said resistor ladder, each coupled to a corresponding one of said plurality of adjustable tap resistors, each first resistor comprising:

a plurality of second resistors coupled in series forming a plurality of first junctions; and first switch logic that inserts said corresponding one of said plurality of adjustable tap resistors at one of said plurality of first junctions;

a programmable non-volatile memory that stores at least one digital gamma value;

select logic, coupled to said memory, to said first switch logic and to said plurality of adjustable tap resistors, that controls said first switch logic and that selects each of said selectable tap voltages according to said at least one digital gamma value; and a plurality of buffers having inputs receiving selected tap voltages and outputs that provide a plurality of gamma correction voltages.

15. The IC of claim 14, wherein each of said plurality of adjustable tap resistors comprises:

a plurality of resistors coupled in series and forming a plurality of junctions; and switch logic that selects one of said plurality of junctions.

16. The IC of claim 14, wherein:

each of said plurality of adjustable tap resistors comprises:

a plurality of third resistors coupled in series and forming a plurality of second junctions; and second switch logic that selects one of said plurality of second junctions; and said select logic providing a gross adjustment to each said first switch logic and a fine adjustment to each said second switch logic.

17. The IC of claim 14, further comprising:

a set of latches, coupled to said memory, that enables programming and selection of a plurality of a plurality of digital gamma values in said memory; and control logic providing address control to said memory for selecting one of said plurality of digital gamma values.

18. An imaging system, comprising:

an imaging device having a gamma factor;

a driver circuit that provides a set of DC reference voltages to said imaging device based on a set of gamma corrected bias voltages; and a programmable gamma correction voltage generator that provides said set of gamma corrected bias voltages configured to compensate for said gamma factor, said programmable gamma correction voltage generator comprising:

a reference voltage coupled across a resistor ladder comprising a plurality of resistors coupled in series and forming a plurality of intermediate junctions;

a plurality of potentiometers distributed along said resistor ladder and providing a plurality of variable tap voltages, wherein each of said plurality of potentiometers is inserted at a corresponding one of said plurality of intermediate junctions;

a programmable non-volatile memory that stores at least one digital gamma value;

select logic, coupled to said memory and to said plurality of potentiometers, that selects from among said plurality of intermediate junctions for inserting said plurality of potentiometers and that selects each of said variable tap voltages according to said digital gamma value; and a plurality of buffers having inputs receiving selected tap voltages and outputs that provide said set of gamma corrected bias voltages.

19. The imaging system of claim 18, wherein said programmable gamma correction voltage generator is incorporated on an IC.

20. The imaging system of claim 18, wherein said imaging device comprises an LCD panel.

21. The imaging system of claim 18, further comprising control logic coupled to said memory via address control, wherein said control logic enables selection of a plurality of digital gamma values stored in said memory.

* * * * *